United States Patent [19]

Smith

[11] 4,166,301

[45] Sep. 4, 1979

[54] APPARATUS FOR CLEANING PIPE

[76] Inventor: Eugene D. Smith, 3100 Hollins, Bakersfield, Calif. 93305

[21] Appl. No.: 909,969

[22] Filed: May 26, 1978

[51] Int. Cl.[2] ..... B08B 9/02

[52] U.S. Cl. ..... 15/88; 15/104.04; 15/104.1 R

[58] Field of Search ..... 15/104.03, 104.04, 104.05, 15/104.1 R, 88

[56] References Cited

U.S. PATENT DOCUMENTS

| | | | |
|---|---|---|---|
| 1,692,028 | 11/1928 | Elliott | 15/104.04 |
| 2,152,036 | 3/1939 | Froh | 15/88 |

*Primary Examiner*—Edward L. Roberts

*Attorney, Agent, or Firm*—Donald D. Mon

[57] ABSTRACT

Apparatus for cleaning the inside and outside walls of a pipe. The apparatus includes a frame, rail means mounted on the frame, and a carriage mounted on the rail means. Derrick means is cantilevered from the carriage means and carries a stinger to be inserted into a pipe supported on the frame. The stinger carries cleaning means for the inside of the pipe. The carriage also carries cleaning means for cleaning the outside of the pipe. The pipe is rotatably supported on the frame and is rotated while the carriage is moved so as to move the pair of pipe cleaning means along the inside and outside walls of the tube to clean them. Fluid can be injected through the stinger to assist the cleaning of the inside of the pipe.

14 Claims, 6 Drawing Figures

APPARATUS FOR CLEANING PIPE

This invention relates to apparatus for cleaning the inside and outside walls of a pipe.

Pipes such as oil well tubing and casing become incrusted in use with various types of deposits and growths. It is desirable to remove this material so the pipe can be reused. Wire brushes and the like will usually suffice for the outside, and a scraper of some sort will usually due for the inside. However, the length of the pipe involved is usually quite long-on the order of perhaps 40 feet, and this requires a device of substantial size and length to carry out the operations. It is an object of this invention to provide a rugged device of reasonable size for cleaning such pipe.

Apparatus according to this invention includes a frame, rail means on the frame, and carriage means mounted to the rail means for axial movement thereon, the carriage means engaging both the top and bottom surface of the rail, whereby to resist rotation around an axis oblique to the rail's axis. Derrick means is mounted to the carriage means and is cantilevered axially beyond the carriage means. A stinger is mounted to the derrick extending axially and spaced laterally from the derrick. The stinger is adapted to carry interior pipe cleaner means on its end closest to the carriage for cleaning the inside wall of the pipe. Pipe support means is mounted to the frame to support a pipe to be cleaned in axial alignment with the stinger. Rotary means is provided for rotating the pipe on the pipe support means, and external pipe cleaner means is mounted to the carriage means to clean the outside wall of the pipe. Carriage shifting means interlinks the frame and the carriage for shifting the carriage on the rail means whereby to move both of the pipe cleaner means along the pipe while the pipe rotates relative to them, thereby to treat the full length and circumference of the pipe.

According to a preferred but optional feature of the invention, the rail means comprises a pair laterally spaced-apart rails, and the carriage means includes two sets of four wheels each engaging the top and bottom bearing surfaces of the respective rail, in pairs.

According to still another preferred but optional feature of the invention, the rotary means for rotating the pipe comprises a gear threaded to a thread at the end of said pipe, and power means for turning the gear.

The above and other features of this invention will be fully understood from the following detailed description and the accompanying drawings, in which.

Figures 1, 2, 3, 4, 5, 6:
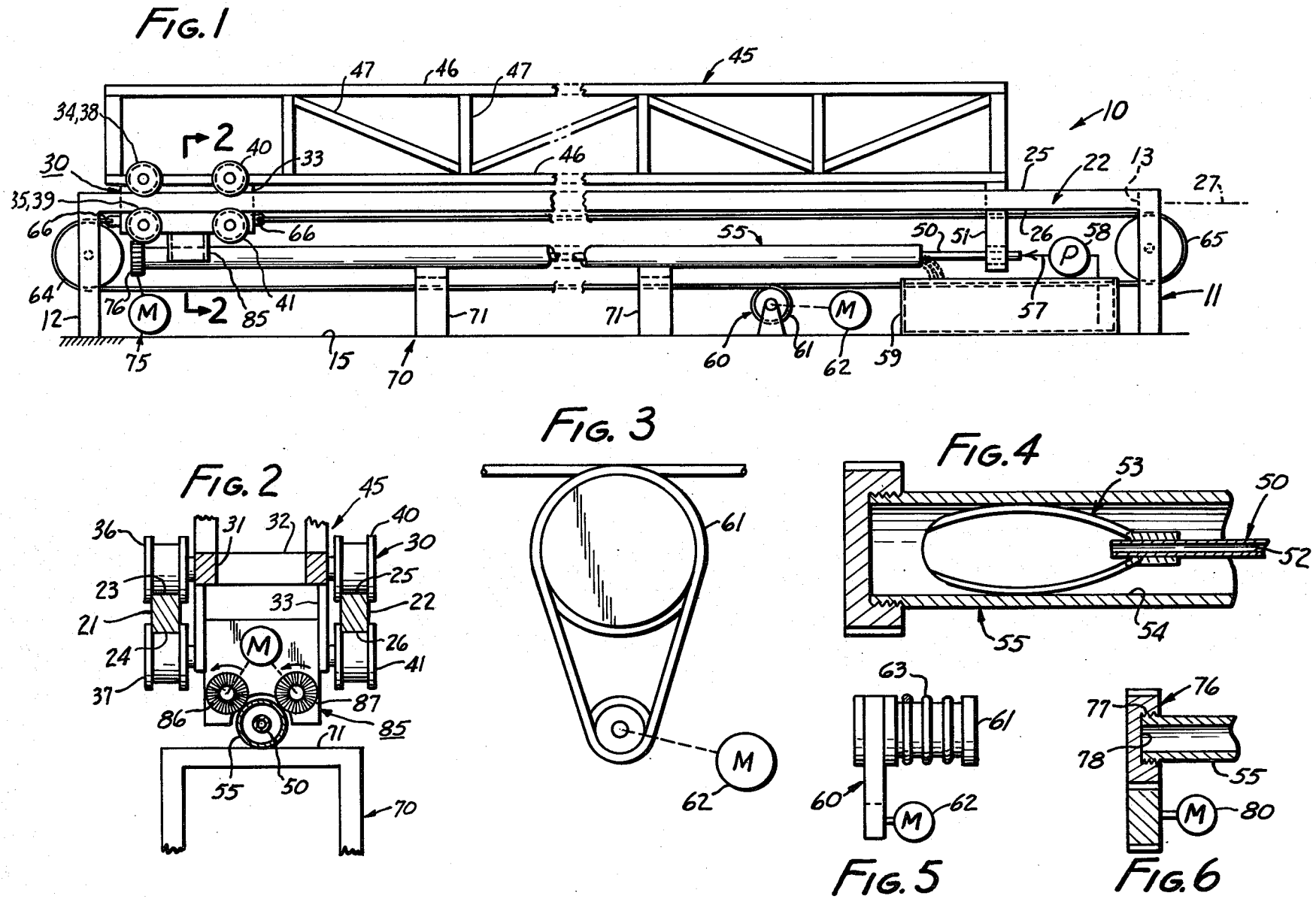
FIG. 1 is a side elevation of the presently-preferred embodiment of the invention.
FIG. 2 is a cross-section taken at line 2—2 of FIG. 1.
FIG. 3 is a side elevation of a windlass used in FIG. 1.
FIG. 4 is a fragmentary axial section showing the interior cleaner means.
FIG. 5 is a side view of the windlass of FIG. 3.
FIG. 6 is a cross-section of a gear device for the pipe.

As best shown in FIG. 1 the apparatus 10 includes a frame 11 including a plurality of upright legs 12, and cross-members 13. These are assembled into a rigid frame which can either be mounted to wheels or placed directly on the ground 15.

The frame includes rail means 20 which comprises a first rail 21 and a second rail 22. First rail 21 includes top and bottom surfaces 23, 24 and second rail 22 includes top and bottom surfaces 25, 26. The rails extend axially along the longitudinal axis 27 of the apparatus. The rail means forms a rigid part of the rigid frame and is supported above the ground by the legs.

A carriage means 30 is mounted to the rail means so as to be axially shiftable thereon. As best shown in FIGS. 1 and 2 the carriage means comprises a group of longitudinal members 31, cross-members 32, and vertical members 33 which form an open box-like construction. The carriage means is mounted to the rails by wheels in two sets of four wheels on each side. Engagement with first rail 21 is made by wheels 34, 35, 36, 37, and with rail 22 by wheels 38, 39, 40, 41. These engage the top and bottom surfaces of the rails in axially spaced apart pairs so as to resist rotation of the carriage around an axis oblique to longitudinal axis 27.

Evidently only one rail, or more than two rails could be used instead of two, and the wheels would be made appropriate in number and arrangement.

A derrick 45 is mounted to the carriage and cantilevered therefrom. Its cantilevered weight is the reason for the use of the plurality of pairs of top and bottom wheels on each of the rails. The derrick includes stringers 46 and cross-braces 47 in the form of a truss. Its purpose is to support beneth it a stinger 50. The stinger does not rotate in this embodiment, and cantilevers from a vertical arm 51 and points toward the carriage. It is laterally spaced from the derrick and is disposed between the two side rails. It is obvious that as the carriage travels back and forth so does the stinger.

As best shown in FIG. 4 the stinger has a central passage 52, and at its end interior pipe cleaner means 53. The particular embodiment shown is known as a scraper or basket blade, with a plurality of cutting edges adapted to engage and scrape clean the inside wall 54 of pipe 55. A flexible hose 57 is connected to the central passage 52. It is fed, with liquid by pump 58 from sump 59. Therefore liquid such as water, oil or any other suitable substance to assist cutting and cleaning can be fed into the stinger passage and ejected at the cutter means. It then can flow out the end of the pipe and into the sump together with the detritus removed by the interior cutting means.

Carriage shift means 60 is mounted to the frame and comprises a windlass 61 which is driven by power means 62. Power means 62 may conveniently be a bidirectional hydraulic motor so that the windlass can be turned one way or the other as desired. A cable 63 is formed as a loop by being run over idlers 64, 65 at opposite ends of the frame and the ends are connected to the carriage at a point or joints 66. The cable is wound three or four times around the windlass. Rotation of the windlass in one direction or the other will drive the carriage means in one direction or the other.

The length of travel of the carriage should be made sufficient that the stinger will be withdrawn from the end of a pipe of intended length to be cleaned, and the length of the stinger should be such as to clean substantially the entire length of the pipe. It is of course possible to reverse the pipe and clean it from each end if shorter stroke machinery is desired to be used, but usually a single pass is to be preferred.

Pipe support means 70 is provided between the rails and preferably somewhat below them to support the pipe to be cleaned and to hold it in axial alignment with the rails. It may comprise standards 71, or cross-members 72 on which the pipe rests. These permit the pipe readily to be rotated. Rotary means 75 is provided to turn the pipe. Preferably this means comprises a gear 76 which can be threaded to an external thread 77 on the end of the pipe. Also, preferably the interior of the gear is closed to form a plug 78 to close end 79 of the pipe. The rotary means also includes a motor 80 which may be a hydraulic type motor engaged to the gear to rotate the pipe. When such a plug is provided then the fluid will all escape from the other end of the pipe.

Exterior pipe cleaner means 85 is mounted to the carriage. This may comprise a plurality of rotary wire brushes 86, 87 which rotate counter to the rotation of the pipe itself for maximum cleaning effect. Instead of brushes or the interior scrapers other known types of cleaning devices can be used such as grinders and surface finishers or the like. However, the devices shown are very effective in cleaning up oil well casing pipe, and this represents at present the best use of the apparatus.

In operation, the pipe is loaded on to the pipe support means and the rotary means is threaded to the end of the pipe. Then at this time the carriage will have been moved all the way to the right in FIG. 1 so that the stinger will not yet have entered the pipe. The rotary means starts to rotate the pipe, and the exterior pipe cleaner means are also placed in operation and then the carriage is moved to the left by turning the windlass in the appropriate direction. This introduces the stinger and its interior pipe cleaner means into the pipe, and it proceeds to clean the inside of the pipe while the exterior pipe means cleans the outside. The interior pipe cleaner means need not itself rotate, but could, and could be mounted and powered for rotation. The external pipe cleaner means need not rotate, but preferably does. What is important is the relative movement between the pipe and the cleaner means. Rotation of the pipe relative to non-rotating cleaning means often will be sufficient. When it is desired to use fluid to assist the cleaning operation it is pumped into the passage in the stinger to the interior cleaner means, and there is discharged from the right hand end of the pipe. When the inward stroke is completed, the pipe rotation can be stopped if desired or it can be maintained as the carriage is returned to its original position. After this cleaning operation is concluded, the rotary means is disconnected, perhaps by reversing its rotation while holding the pipe. The pipe is then removed and replaced with another pipe to be cleaned.

It will be seen that this construction is elegantly simple and requires a total length on the highway only slightly in excess of that of the maximum length of pipe to be cleaned on the machine in a single stroke. The device can therefore be made quite portable if desired, or can be made sufficiently heavy that it may be preferable to leave it permanently in place and bring the pipe to it. However, it is a considerable advantage not to have to haul pipe around any more than necessary and this device can readily be truck or trailer mounted and brought to the pipe.

This invention is not to be limited by the embodiment shown in the drawings and described in the description which is given by way of example and not of limitation, but only in accordance with the scope of the appended claims.

I claim:

1. Apparatus for cleaning the inside and outside walls of a pipe having a longitudinal axis, said apparatus comprising:

a frame;

rail means on said frame having an axis and a top and bottom bearing surface;

carriage means mounted to said rail means for axial movement thereon, said carriage means engaging both the top and bottom bearing surfaces whereby to resist rotation around an axis oblique to the rail axis;

derrick means mounted to said carriage means and cantilevered axially beyond said carriage means;

a stinger mounted to said derrick extending axially and spaced laterally from said derrick;

said stinger being adapted to carry interior pipe cleaner means adjacent to its end closest to the carriage for cleaning said inside wall of said pipe;

pipe support means mounted to said frame to support a pipe to be cleaned in axial alignment with said stinger;

rotary means for rotating the pipe on said pipe support means;

external pipe cleaner means mounted to said carriage means to clean said outside wall of said pipe; and carriage shifting means interlinking said frame and said carriage for shifting said carriage on said rail means whereby to move both of the pipe cleaner means along the pipe while the pipe rotates relative to them, whereby to treat the full length and circumference of said pipe, said rail means being of sufficient length that the stinger with the pipe cleaner means attached can be withdrawn from the pipe in order to place pipe to be cleaned on the pipe support means and to run the stinger and the interior pipe cleaner means into the pipe to clean the inside of the pipe and run the external pipe cleaner means along the outside of the pipe to clean the outside wall of said pipe.

2. Apparatus according to claim 1 in which the rail means comprises a pair of laterally spaced-apart rails, and in which the carriage means includes two sets of four wheels one for each rail, engaging the top and bottom bearing surfaces of their respective rail, in pairs.

3. Apparatus according to claim 1 in which the stinger includes an axial passage from end to end, and in which hose means is connected to the end of the stinger remote from the carriage to supply fluid to the interior cleaner means.

4. Apparatus according to claim 3 in which said rotary means comprises a gear mounted to said pipe, and power means for turning said gear.

5. Apparatus according to claim 4 in which said gear includes an internal thread threadable onto a thread on an end of the pipe, and in which said gear includes an imperforate central plug to close said end of said pipe.

6. Apparatus according to claim 4 in which said external pipe cleaner means comprises rotary cleaning elements mounted to said carriage means to engage and clean said pipe.

7. Apparatus according to claim 6 in which said carriage shifting means comprises a cable connected to the carriage means, a windlass mounted to said frame, said cable being wrapped around said windlass, and bi-directional power means to turn said windlass and move said carriage means bi-directionally.

8. Apparatus according to claim 7 in which the rail means comprises a pair of laterally spaced-apart rails, and in which the carriage means includes two sets of four wheels, one for each rail, engaging the top and bottom bearing surfaces of the respective rail, in pairs.

9. Apparatus according to claim 3 in which the end of the pipe remote from the stinger is plugged, whereby fluid in the pipe discharges from the end of the pipe remote from the carriage means.

10. Apparatus according to claim 1 in which said rotary means comprises a gear mounted to said pipe, and power means for turning said gear.

11. Apparatus according to claim 10 in which the end of the pipe remote from the stinger is plugged, whereby fluid in the pipe discharges from the end of the pipe remote from the carriage means.

12. Apparatus according to claim 10 in which said gear includes an internal thread threadable onto a thread on an end of the pipe, and in which said gear includes an imperforate central plug to close said end of said pipe.

13. Apparatus according to claim 1 in which said external pipe cleaner means comprises rotary cleaning elements mounted to said carriage means to engage and clean said pipe.

14. Apparatus according to claim 1 in which said carriage shifting means comprises a cable connected to the carriage means, a windlass mounted to said frame, said cable being wrapped around said windlass, and bi-directional power means to turn said windlass and move said carriage means bi-directionally.

* * * * *